US006786766B1

(12) United States Patent
Chopra

(10) Patent No.: US 6,786,766 B1
(45) Date of Patent: Sep. 7, 2004

(54) ELECTRICAL OUTLET BOX WITH SECURE QUICK CONNECT AND RELEASE FEATURES

(75) Inventor: Kewal K. Chopra, Sterling Heights, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/719,847

(22) Filed: Nov. 24, 2003

(51) Int. Cl.[7] ..... H01R 13/66
(52) U.S. Cl. ..... 439/535; 439/441
(58) Field of Search ..... 174/50–57; 439/535, 439/441, 438, 650, 652

(56) References Cited

U.S. PATENT DOCUMENTS 3,038,141 A * 6/1962 Chiuchiolo ..... 439/650
3,662,085 A * 5/1972 Robinson et al. ..... 174/48
3,814,834 A * 6/1974 Glader ..... 174/57
4,163,882 A * 8/1979 Baslow ..... 200/296
4,165,443 A * 8/1979 Figart et al. ..... 174/53
4,725,249 A * 2/1988 Blackwood et al. ..... 439/535
4,756,695 A * 7/1988 Lane et al. ..... 439/76.1
4,845,312 A * 7/1989 Lee ..... 174/65 R
5,012,043 A * 4/1991 Seymour ..... 174/57
5,117,122 A * 5/1992 Hogarth et al. ..... 307/140
5,223,673 A * 6/1993 Mason ..... 174/53
5,380,951 A * 1/1995 Comerci et al. ..... 174/48
5,471,012 A * 11/1995 Opel ..... 174/53
5,558,536 A * 9/1996 Horton ..... 439/535
5,645,449 A * 7/1997 Sabo ..... 439/540.1
5,785,551 A * 7/1998 Libby ..... 439/535
5,804,764 A * 9/1998 Gretz ..... 174/53
5,936,199 A * 8/1999 Lutz ..... 174/53
6,191,361 B1 * 2/2001 Matty ..... 174/53
6,267,613 B1 * 7/2001 McCoy et al. ..... 439/281
6,280,233 B1 * 8/2001 Beege et al. ..... 439/441
6,423,897 B1 * 7/2002 Roesch et al. ..... 174/50
6,443,746 B1 * 9/2002 Yu ..... 439/107
6,444,906 B1 * 9/2002 Lewis ..... 174/53
6,468,107 B1 * 10/2002 Nice et al. ..... 439/536
6,530,806 B2 * 3/2003 Nelson ..... 439/528
6,547,588 B1 * 4/2003 Hsu et al. ..... 439/535
6,617,511 B2 * 9/2003 Schultz et al. ..... 174/53
6,642,450 B1 * 11/2003 Hsiao ..... 174/53

* cited by examiner

*Primary Examiner*—Ross Gushi
*Assistant Examiner*—Larisa Tsukerman
(74) *Attorney, Agent, or Firm*—David L. Kuhn; Clifford C. Carter; Gail S. Soderling

(57) ABSTRACT

An electrical outlet or junction box is provided herein for interiorly accommodating at least one electrical device and at least one cable furnished to said box by a manual source. A secure, quick connect and release capability for electrically connecting said cable and electrical device is supplied by one or more terminal blocks that are mounted to an interior wall of said box. These blocks carry at least one receiving means and at least one releasing means along an exterior surface. The box itself, comprises a rear wall which is perimetrically bounded by an outer wall that extends outwardly from said rear wall to define an integral structure with an open front opposite of the rear wall. The electrical device is then energized by supplying said cable with electricity from an external power source.

9 Claims, 3 Drawing Sheets

ELECTRICAL OUTLET BOX WITH SECURE QUICK CONNECT AND RELEASE FEATURES

GOVERNMENT INTEREST

The invention described herein may be made, used, and licensed by, or for, the United States Government for governmental purposes without paying me any royalty.

BACKGROUND AND SUMMARY

This invention pertains to junction or electrical outlet boxes which are used for receiving one or more power cables and connecting thereto one or more electrical devices, housed within said boxes, to provide power to one or more external electrical appliances by means of a connector, plug, jack, or like device. More particularly, this invention provides a box suitable for wiring such devices with a secure, quick connect and release capability. It is to be understood herein that proper procedures must be followed when working with electrical devices to prevent shock or harm. Namely, the connection to the power source should be open or disconnected.

An electrical outlet or junction box is provided herein for interiorly accommodating at least one electrical device and at least one cable that have been furnished to said box by a manual source. A secure, quick connect and release capability for electrically connecting said cable and said electrical device in this box is supplied by one or more terminal blocks that are mounted to at least one interior surface of said box. The blocks carry at least one receiving means and at least one releasing means along an surface. The electrical device is then energized by supplying said cable with electricity from an external power source. The box, itself, comprises a rear wall which is perimetrically bounded by an outer wall that extends outwardly from said rear wall to define an integral structure with an open front opposite of the rear wall. The box is closed by use of an apertured faceplate or cover to protect the box interior, the cable, and the electrical device from debris and moisture as well as to provide safety by limited access and fire containment. The faceplate is dimensioned and shaped to assist mounting of the electrical device within said box and to also accommodate receipt of an electrical connector from a major electrical appliance that is external to said box and not a part of this invention. This box is conveniently mounted to any structure by its placement within a suitable aperture previously formed within a wall, ceiling, or floor of the structure using conventional skills.

Previous innovations over the years for outlet boxes have provided better ways for mounting the box, retaining the electrical devices and wiring, and securing the cables. Typically, these boxes are produced from either metals or metal alloys using conventional metal working technologies. They are also made of rubbers, rubber composites, plastics, plastic composites, reinforced plastics, and combinations thereof by conventional molding processes which employ one or more operating steps.

Traditionally, these boxes are supplied to the trade in a variety of geometric sizes and shapes based upon their ultimate application. The most prevalent concerns in the art are to provide adequate volumes for housing the electrical devices and the various wiring components. I therefore anticipate that my boxes will also be made from these materials and will have similar sizes or shapes. Alternatively, a commercial box may be purchased and modified to provide the quick connect and release features of my invention.

A typical commercial box comes with at least one aperture therein that is formed in at least one wall, such as the top, rear, bottom, or side walls. This aperture may also be supplied as a preformed, weakened structure, known in the art as knock-outs, punch-outs, and the like. These openings allow ready ingress and egress to the internal volume of an outlet box by one or more, uncut, sheathed cables.

In a typical installation procedure, the cables are stripped of their sheathing to reveal three insulated, solid conductors (live, neutral, and ground). Thereafter, the conventional techniques of a tradesman are applied to strip the insulation from the conductor tip to thereby expose a solid wire. As used herein, wiring components are exemplified by the proceeding cables, conductors, and wires. It is also understood herein that wires composed of multiple strands may be used in this invention provided that they are first solidified by solder or tinning procedures to adequately perform as a solid wire during my installation process. Thereafter, the solid wire is used to connect the electrical device and box together. Any cables that exit the box do so through the same or similar apertures to make further connections within the structure being electrified.

Typical electrical devices powered by solid conductors will include receptacles, sockets, switches, and electrical fixtures. Fixture examples are phone jacks, computer jacks, cable TV terminals, local area network (LAN) jacks, or any of the combinations thereof. The opening of an outlet box is then closed by a face plate or cover that has one or more apertures therein which are dimensioned and shaped to receive and/or accommodate a powered electrical connection to an external electrical appliance by the use of simple connectors. Other functions of the faceplate are to shelter the internal contents within the box from debris and moisture, to provide safety by preventing the spread of fire from the box, and to reduce easy access to the box interior and its contents. Internal contents, as used above, refers to the wiring components, the electrical device, and the quick connect and release features of my invention supplied by terminal blocks to be further discussed below. Usually, the faceplate or cover is made of the same materials as the outlet box, and the continuation of this practice is also contemplated herein. As used herein, electrical connectors contemplate prongs, plugs, jacks, and like connectors that have been previously used to energize major appliances.

These boxes may also be used as junction boxes to join electrical cables together to improve reliability, as compared to having just one cable, to supply electricity throughout an entire structure. Dependent upon the particular service need, the electrical outlet or junction boxes herein can also be joined together, in gangs or clusters, consisting of side by side, back to back, and bottom to top arrangements.

A particular problem with today's prior art is that elongated stripped-conductor tips are routinely joined by twisting, and thereafter forcing the resulting rigid mass into a suitable coupling device, such as a wire nut. For good electrical conductivity, it is essential that the tradesman apply sufficient force to the wire nut and twisted conductors to make a satisfactory connection. This is frequently a time consuming and difficult task to perform since the conductors and attendant wires are rigid and difficult to permanently twist together by either mechanical or manual methods. It is therefore no surprise that the principal costs of wiring new or remodeled structures are for the skilled labor of either an electrician or a tradesman.

Present day electrical systems of industrial sites; homes; businesses; and water, ground, or air transports, are composed of a plurality of wiring connections that are made in the above manner. The space within the outlet box becomes unusually confined after crowding therein the wire nuts, stiff conductors, electrical devices, and the like. This problem has led to the modern development of boxes with deeper or adjustable walls to form larger volumes.

From time to time, it is necessary for someone to inspect and/or trouble-shoot an electrical system. It is often difficult for an inspector to dress or trace the numerous cables, conductors, and wires of a standard outlet box from their origin to end. This task is rendered all the more complex due to the confined space of the outlet box. As more stress is applied to the electrical connections to complete said inspection, the possibility of electrical shorts or loss of conductivity is all the more probable because of the potential disengagement of a wire nut or separation of an electrical connection.

This undesirable situation is further exacerbated when the affected electrical system is a crucial part of a much larger, integrated-system, such as a military installation; a weapons system or combat transport; a public safety facility, like a prison, police station, or fire hall; and/or a health care facility with life-support equipment located therein. Because such facilities have unique power requirements, it is unlikely that considerable time will be available to find a quick solution for an electrical problem using today's procedures and equipment as above described. As an immediate consequence, severe injury or death may be a possible outcome of any delay in a troubleshooting process.

The prior art does not disclose the many advantages and benefits of my invention; nor do they teach or suggest my inventive approach or elements. My invention will conceptually terminate the use within the art of wire nuts and like connectors, will eliminate the tedious task of twisting wires, will reduce time for connection or disconnection of wires, and will allow the ready tracing or dressing of wires in quick order.

It is therefore an object of the claimed invention to provide a secure, quick, and easy connect or disconnect means for connecting one or more conductors electrically within a junction or outlet box. The adoption of this invention will also allow for the quick and easy verification of the origination and departure of a conductor at an electrical junction or outlet box by minimal effort.

These and other objects, features, and advantages of this invention will be apparent to those skilled in the relevant arts upon a full reading of this specification and the appended claims which explain and define the aspects and principals of this invention.

DETAILED DESCRIPTION

Figure 1:
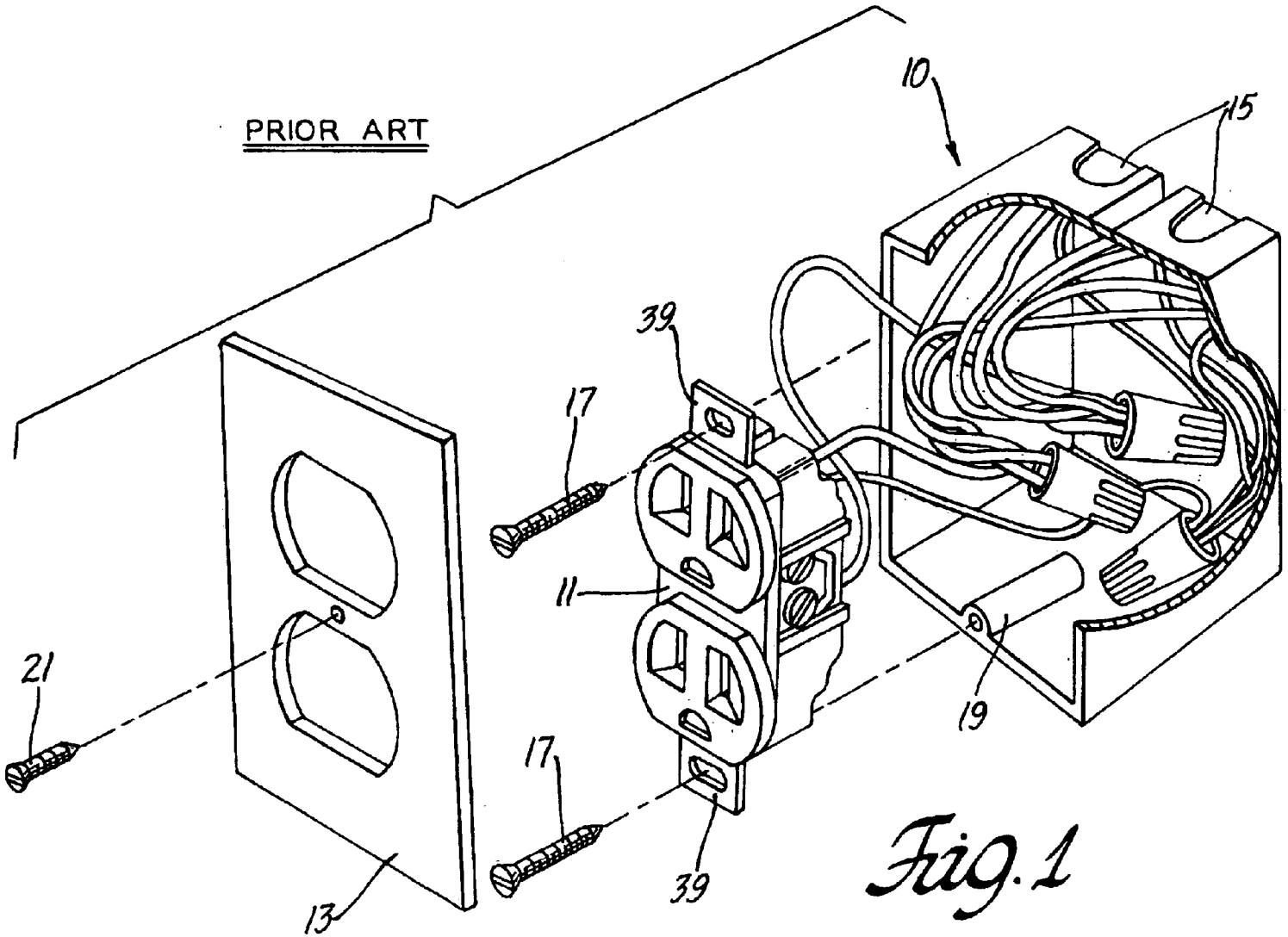
FIG. 1 is an exploded view in perspective of a wired outlet box of the prior art partially broken away to reveal electrical connections and overall assembly techniques.

To further illustrate my invention, reference is now made to FIG. 1 which is a perspective view, in breakaway section, of an outlet box 10 of the prior art. Therein, three wire nuts have been employed to make electrical connections between an electrical device 11 and three or more solid conductors within the box. Further, the joined conductor tips are held together by wire nuts which respectively secure groups of live wires 12, neutral wires 14, and ground wires 16. The three wires extending out of this box are then used to establish the electrical connections that are necessary to energize the device 11. Thereafter, a preselected external electrical connector (not shown) of an electrical appliance (not shown) is used to penetratingly connect said electrical device and appliance with subsequent electrical power provided to the appliance.

FIG. 1 also shows a faceplate or cover 13 for said box, and potential entry or exit aperture(s) 15 scored on said box through which uncut, sheathed cables can be introduced. After the sheathing is removed, each cable will in turn provide three insulated conductors with exposed, bare tips after the insulation is removed. These bare conductor tips or solid wires will then receive the appropriate wire nuts, according to polarity, as needed for power. It is to be understood that additional apertures may also provide cable access at the rear of the box or through other walls. A similar situation is contemplated for the box of this invention. The electrical device 11 is conveniently mounted to the front box 10 by screws 17 that align to penetrate one or more, threaded or unthreaded, ears, tabs, rails, or bosses 39 which were earlier formed during construction of either the electrical device or the outlet box. The faceplate 13 is then held to the box 10 opening by a separate screw 21 which penetrates a threaded aperture (not shown) located equidistantly between the sockets at the center of device 11.

Figure 2:
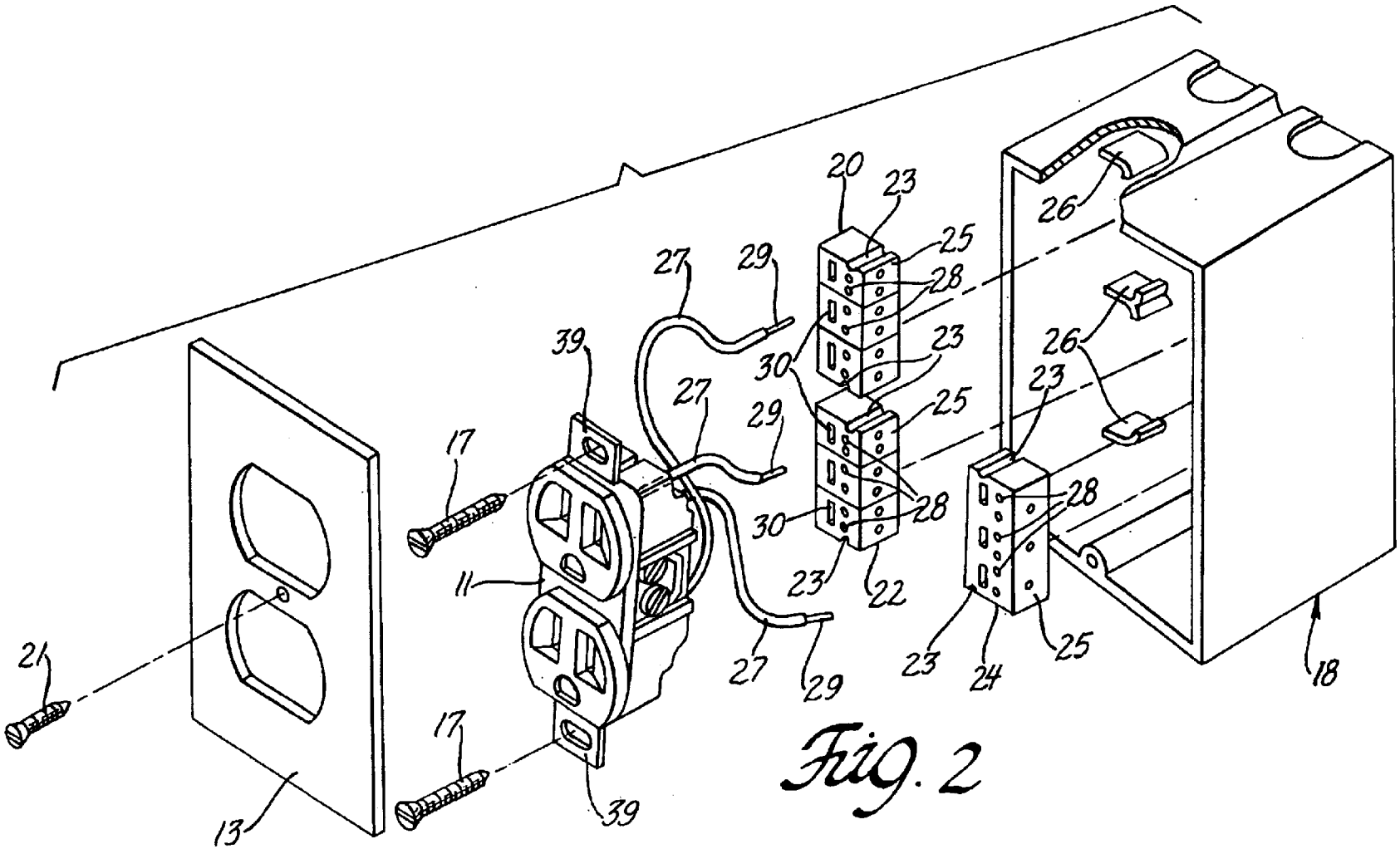
FIG. 2 is an exploded view in perspective of an outlet box of this invention partially broken away to reveal its assembly.

I now propose an electrical outlet box 18 of FIG. 2 as a replacement for the currently employed FIG. 1. As mentioned above, my box is readily formed of any suitable material of choice, such as metal, plastic, or the composites thereof. The exterior geometries of box 18 are essentially the same as those currently available, and it is mounted to a structure in the same manner by simply forming an opening in a wall, ceiling, or floor. Moreover, conventional box mounting and cable gripping components of the art can also be used herein.

Interiorly positioned within box 18 are terminal blocks 20, 22, and 24 which will each accept solid wire conductor tips 29 according to their common polarity, including positive, neutral, and ground wires, as chosen by an electrician installing my box. It is to be noted that each terminal block may be an integral unit as shown on block 24 with a plurality of conductor receiving means 28 and a multiplicity of releasing means 30. A typical receiving means as used herein is one or more- rounded apertures within the exterior surface 35 of the terminal block as depicted in FIGS. 2–5. A typical releasing means herein is an elongated, vertical slot also generally depicted in FIGS. 2–5.

Alternatively, each terminal block may be comprised of one or more cells with each cell having one or more receiving means and one or more releasing means. A version of this latter terminal block is shown in FIG. 2 as 20 and 22. Consideration should be made to provide more or less cells when required for a particular application. It is also preferred that terminal blocks, regardless of whether in an integral or multi-cellular form, will have all receiving means 28 and all releasing means 30 aligned in a vertical and dimensionally spaced apart relationship as shown in FIGS. 2–5.

Figure 5:
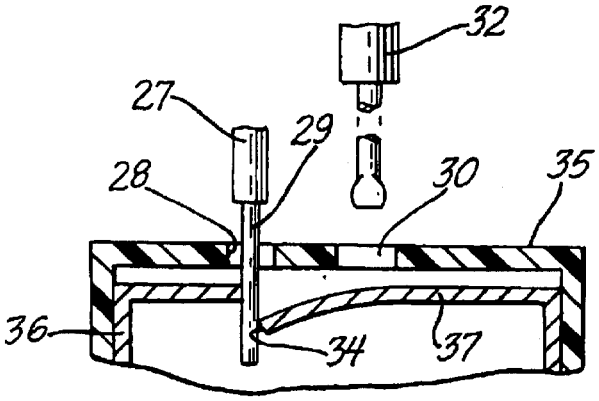
FIG. 5 is a section taken along the line 5—5 of FIG. 4 showing the further act of insertion of bare conductor tips into the receiving and gripping means of this invention and their subsequent release by insertion of a depression tool within a depression slot of this invention.

It is also preferred that these means be equally spaced apart from one another to allow and accommodate the placement or removal of solid conductor tips 29 as they are forcibly inserted or released by manual force of a tradesman or installer using a hand (to install) or a depression tool 32 (to release) said conductors 27 from my blocks. This is quickly done in a single forceful motion by the installer while holding said conductor or tool in the hand. Referring to FIG. 5, the immediate result is the secure capture or release of the conductor tip 29 by a gripping means 34 of the terminal block. This provides a multitude of very secure, space-saving connections and/or releases by my outlet box. A simple form of the gripping means 34 is a spring set comprised of a base spring 36 and a flex spring 37 as further described herein.

My terminal blocks are secured to the internal surfaces of a conventional outlet box 10, or my box 18, by a plurality of fastening means 26 that are well accepted and known in the field of construction for electrical boxes and devices. For example, such means can be selected from ears, tabs, rails, bosses, studs, rivets, and screws. The exact selection of which is a matter of personal preference of the installer, or which will be earlier determined by a cost engineering evaluation during a design and analysis for fabrication of my box in commercial quantities. Said blocks are also reversible as shown in FIG. 2 or can be manufactured in mirror image form per terminal block 23 of FIG. 2. While the terminal blocks shown in FIGS. 2–5 are in rectangular form, it is also feasible that other geometric shapes could be possible, such as rounded, more smoother shapes, substantially tubular or oblong in form.

FIG. 2 also shows therein a specific use of one or more pair(s) of tabs as fastening means 26 which will engage the top and bottom of the terminal block(s) along the exterior, outboard surface 25 and at a position remote from the box walls including side, top, bottom, and rear walls. A slight variation of this approach could involve engagement of groove(s) 23 within said blocks by these tabs. Alternatively, the fastening means 26 could also be positioned at the rear of the box 10 and engage the front, exterior surface 35 (not shown) of the block remote from the rear wall; or it could engage a similar groove 23 that is horizontally formed along its exterior 35 (not shown). Also dependent upon cost engineering studies, it is likely that my box, terminal blocks, and associated components will be molded in multi-step production processes to manufacture commercial quantities.

Figure 3:
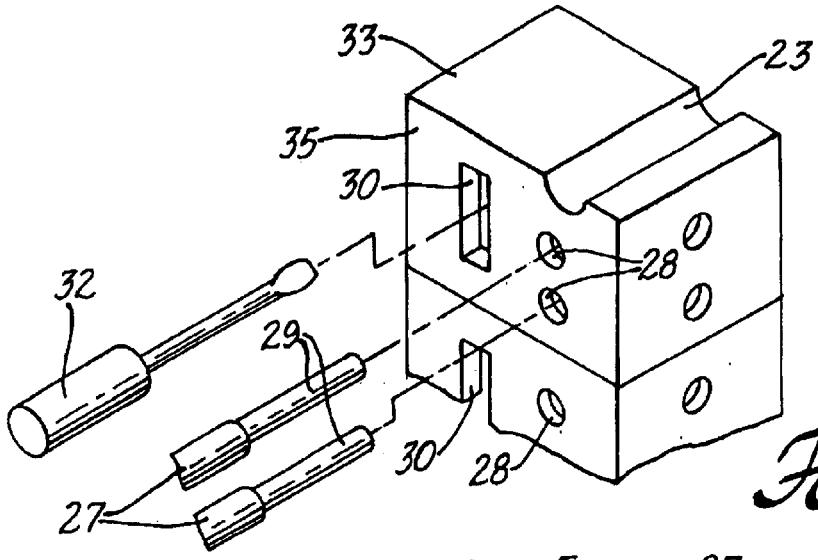
FIG. 3 is an enlarged section taken from the encircled portion of terminal block 20 of FIG. 2 with its prevalent, visible external features displayed with regard to assembly and release.
Figure 4:
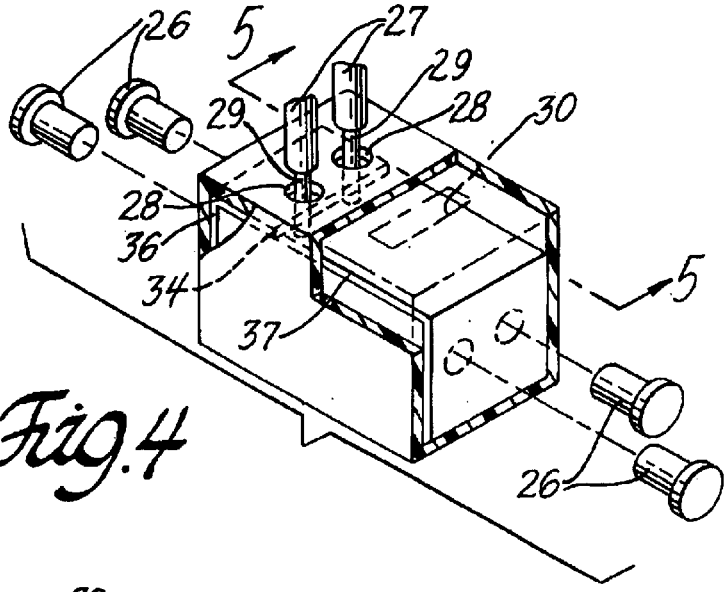
FIG. 4 is a perspective view of the top cell from FIG. 3, resting upon its back, that has been partially broken away to reveal the conductor tips piercing the receiving means and resting upon the gripping means that are used to grasp and/or release conductors inserted therein by manual force.

Referring now to FIGS. 3 and 4, a typical procedure for the deployment of my box 18 calls for the removal of insulation at the tip 29 of conductor 27 to expose a bare metal surface of sufficient length to penetrate the receiving means 28 and thereafter engage the gripping means 34 that is located within a body cavity of the terminal block. It should be understood that the tips are resting on the top of the gripping means and that their actual insertion is more clearly shown in FIG. 4. Moreover, the depression tool 32 is required only to release the conductor tips which is more clearly shown in FIG. 5.

Specifically referring to FIG. 4, the metal spring set of the cell 33 from FIG. 3 is depicted in greater detail. For reference, the cell 33 is an enlarged section taken from the encircled portion of terminal block 20 in my FIG. 2. The subject cell in FIG. 4 is rotated on its back approximately 90° and is viewed from the bottom to reveal therein two metal springs 36 and 37 of L-shaped form. One can see that the elongated, L-shaped spring 37 is larger than its counterpart L-shaped spring 36. This design allows spring 37 to readily flex when bare conductor tips 29 are hand-pushed into receiving means 28, or when it is depressed by tool 32 to release and remove conductor tips 29. In sharp contrast, the smaller spring 36 functions as a rigid, base-spring and allows the conductor tip 29 to become wedged by manual insertion between itself and flex spring 37. If desired, the larger spring 37 can also be scored, slotted, notched or perforated to be more resilient or flexible.

The aforementioned springs are made of conductive metal and are totally embedded within the terminal block or cell in a suitable way to insolate and insulate them from each other and the body cavity in which they are located. The springs utilized herein are selected from metals or metal alloys of copper, brass, beryllium-cooper, and similar conductive materials that possess both reduced oxidation properties and springy characteristics. If need be, these springs can also be permanently attached within the body cavity of the cell or terminal block by the use of additional fasteners 26 or by a multi-step molding process. Thereby, said springs are rigidly mounted within said cell or block by ears, tabs, rails bosses, studs, rivets, screws, and structural design elements or flashings of a plastic molding process.

Proper precautions should be taken, with due regard for avoiding electrical shock, when it is desired to electrically disconnect a conductor arrangement. Namely, the power should be shut off. Disconnection is performed then by reversing the installation procedure and using a depression tool 32 within the releasing means 30 to access gripping means 34 whereby the flex spring 37 is engaged and opened to release the conductor tip 29 from the spatial gap of the spring set between springs 36 and 37. As used herein, the depression tool can be a screw driver, awl, or like pointed tool with an insulated handle. The end opposite of the handle has a tip that is capable of penetration of releasing means 30 sufficiently to depress or relieve the tension of spring 37 against the conductor tip 29. The conductor tip is then removed from receiving means 28. The overall process is further depicted in FIG. 5 which relates to an end view section of the top cell 33 of terminal block 20. This view is taken along the line 5—5 of FIG. 4.

I wish it understood that I do not desire to be limited to the exact details of construction or method shown herein since obvious modifications will occur to those skilled in the relevant arts without departing from the spirit and scope of the claims.

What is claimed is:

1. An electrical outlet box comprising in combination:

(a). a rear wall, a top wall, a bottom wall, and two identical side walls that extend outwardly from the rear wall, with said rear wall being normal to all other walls, and said identical side walls being parallel to each other with said top and bottom walls also being parallel, to thereby define an open enclosure;

(b). an electrical device, having one or more outlets, positioned within said enclosure and said device carrying thereon at least two prepared solid conductors for making electrical connections according to common polarity;

(c). at least one sheathed electrical cable entering the enclosure via a preformed aperture within at least one of said walls, said cable also having a plurality of prepared solid conductors for making electrical connections according to polarity;

(d). a multiplicity of terminal blocks for establishing reliable electrical connection between said electrical device conductors and said cable conductors, said blocks being positioned within and mounted to at least one wall of said enclosure by mounting means;

(e). each terminal block having a substantially rectangular shape that carries thereon first and second receiving apertures having a common polarity, the first aperture adapted for acceptance of a manually inserted conductor of said cable and the second aperture adapted for receiving a manually inserted conductor of the electrical device;

(f). each terminal block also having a body cavity formed therein, for containing an aligned gripping means associated with first and second receiving apertures for grasping and electrically connecting the inserted cable and electrical device conductors;

(g). each terminal block also bearing upon its exterior surface at least one releasing means associated with said first and second receiving apertures for selective release and disconnection of conductors of step (f);

(h). said releasing means adapted for manual insertion of a depression tool into said terminal block to release said gripping means to thereby allow manual removal of cable and electrical device conductors;

(i). an apertured faceplate for closing said open enclosure and protecting contents of said enclosure including said conductors, terminal blocks, and electrical device; and (j). said apertures within said faceplate being dimensioned and shaped to accommodate electrical connection between said electrical device housed within the enclosure and an external electrical appliance by means of an electrical plug piercing outlets of said electrical device.

2. The electrical outlet box of claim 1 wherein the mounting means are selected from the group consisting of ears, tabs, rails, bosses, studs, rivets, screws, and molded design elements.

3. The electrical outlet box of claim 1 wherein electrical devices are selected from the group consisting essentially of receptacles, sockets, switches, and electrical fixtures.

4. The electrical outlet box of claim 3 wherein electrical fixtures are selected from the group consisting essentially of phone jacks, computer jacks, cable television terminals, local area network jacks, and their combinations.

5. The electrical outlet box of claim 1 wherein the depression tool is selected from the group consisting essentially of an awl, screw driver, and a pointed tool.

6. The electrical outlet box of claim 1 wherein said substantially rectangular shape comprises rectangular, cylindrical, and tubular forms.

7. The electrical outlet box of claim 1 wherein said gripping means comprises a metal spring set including a smaller, L-shaped base spring and a larger, L-shaped flex spring.

8. The L-shaped flex spring of claim 7 that has been processed to be more resilient by a method selected from the group consisting essentially of scoring, slotting, notching, or perforating.

9. The electrical outlet box of claim 1 wherein said receiving means is an aperture formed within said terminal blocks by a conventional process selected from drilling and molding.

* * * * *